US009950433B2

(12) United States Patent
Demko

(10) Patent No.: US 9,950,433 B2
(45) Date of Patent: Apr. 24, 2018

(54) DUAL ARM BLADE ENGAGEMENT LOCK FOR FOLDING KNIFE

(71) Applicant: Andrew Demko, Wampum, PA (US)

(72) Inventor: Andrew Demko, Wampum, PA (US)

( * ) Notice: Subject to any disclaimer, the term of this patent is extended or adjusted under 35 U.S.C. 154(b) by 96 days.

(21) Appl. No.: 14/671,184

(22) Filed: Mar. 27, 2015

(65) Prior Publication Data

US 2016/0279810 A1 Sep. 29, 2016

(51) Int. Cl.
*B26B 1/04* (2006.01)

(52) U.S. Cl.
CPC ..... *B26B 1/042* (2013.01)

(58) Field of Classification Search
CPC .. B26B 1/042; B26B 1/02; B26B 1/04; B26B 1/10; B26B 1/044; B26B 1/048; B26B 1/00
USPC ..... 30/153, 155–159, 161
See application file for complete search history.

(56) References Cited

U.S. PATENT DOCUMENTS 4,040,181 A * 8/1977 Johnson ..... B26B 1/042 30/161
6,338,431 B1 1/2002 Onion
6,378,214 B1 4/2002 Onion
7,062,857 B1 * 6/2006 Nenadic ..... B26B 1/042 30/161
7,469,476 B2 2/2008 Demko
8,042,276 B2 3/2011 Lerch et al.
2006/0230620 A1 * 10/2006 Steigerwalt ..... B26B 1/02 30/159
2009/0144986 A1 * 6/2009 Frazer ..... B26B 1/048 30/159

OTHER PUBLICATIONS

Merriam-Webster, definition of pin, https://www.merriam-webster.com/dictionary/pin.*

* cited by examiner

*Primary Examiner* — Kenneth E. Peterson
*Assistant Examiner* — Liang Dong
(74) *Attorney, Agent, or Firm* — Harpman & Harpman

(57) ABSTRACT

A folding knife having an improved locking engagement mechanism that will maintain and hold the knife in an open locked use position or in a locked folded position. The improved locking engagement provides a spring urged dual locking bar engaged directly on the knife blade for an improved imparted force transfer. A positional locking activation safety button is resiliently registerably against an apertured pivot arm extension of the locking bar for locking and unlocking engagement.

10 Claims, 6 Drawing Sheets

DUAL ARM BLADE ENGAGEMENT LOCK FOR FOLDING KNIFE

BACKGROUND OF THE INVENTION

1. Technical Field

This invention relates to folding knives that have a compact configuration in which the knife blade is pivotally attached to a support and enclosure handle, so as to be folder therewithin when not in use. Such knives have locking elements to engage and hold the knife blade in a locked open position for use or a folded closed non-use position. Such locking mechanisms are referred to as locking bar or pin configurations, 2. Description of Prior Art Prior art folding knives have a variety of blade locking engagements structures to accommodate a number of blade lock and release positions, see for example U.S. Pat. Nos. 6,338,431, 6,378,214, 8,042,276, and Applicant's U.S. Pat. No. 7,469,476.

U.S. Pat. Nos. 6,338,431 and 6,378,214 by the same inventor disclose a folding locking knife blade mechanism with lock post selectively engaged on the blade tang.

U.S. Pat. No. 8,042,276 claims a folding knife with a thumb release opening having a push pad that displaces liner lock allowing the blade to rotate from a locked, open, or closed position.

In applicant's U.S. Pat. No. 7,469,476, a folding locking knife is claimed having a spring urge pivot locking bar with a safety pin within the frame that engages the end of the locking bar.

SUMMARY OF THE INVENTION

A dual locking arm for a folding knife to lock and hold the knife blade in locked open use position or in folded handle engagement position. The dual locking arm has a blade shank engagement pin therebetween which is spring urge on a pivot within the handle, and an arm release slidable safety pin that prevents the locking arm from movement by user blade displacement to open or close position of the knife blade.

DESCRIPTION OF THE PREFERRED EMBODIMENT

Figure 1:
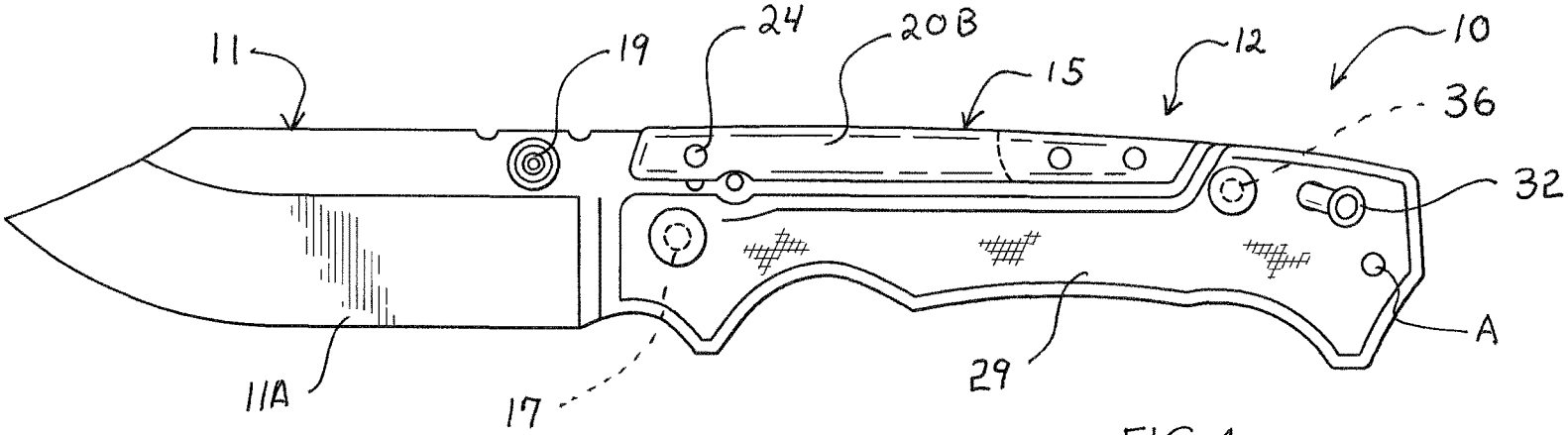
FIG. 1 is a side elevation view of the folding knife in open locked position with locking arm pin in blade registration.
Figure 2:
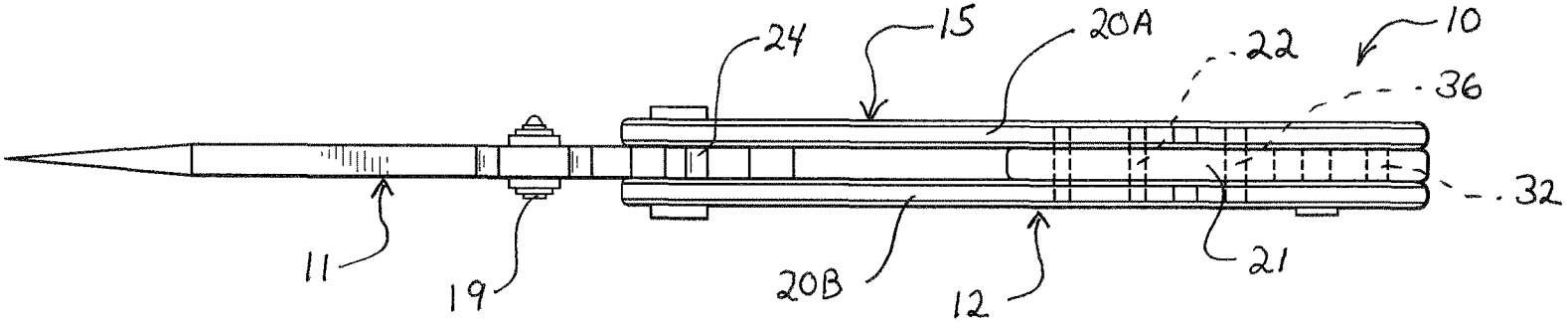
FIG. 2 is a top plan view thereof.
Figure 3:
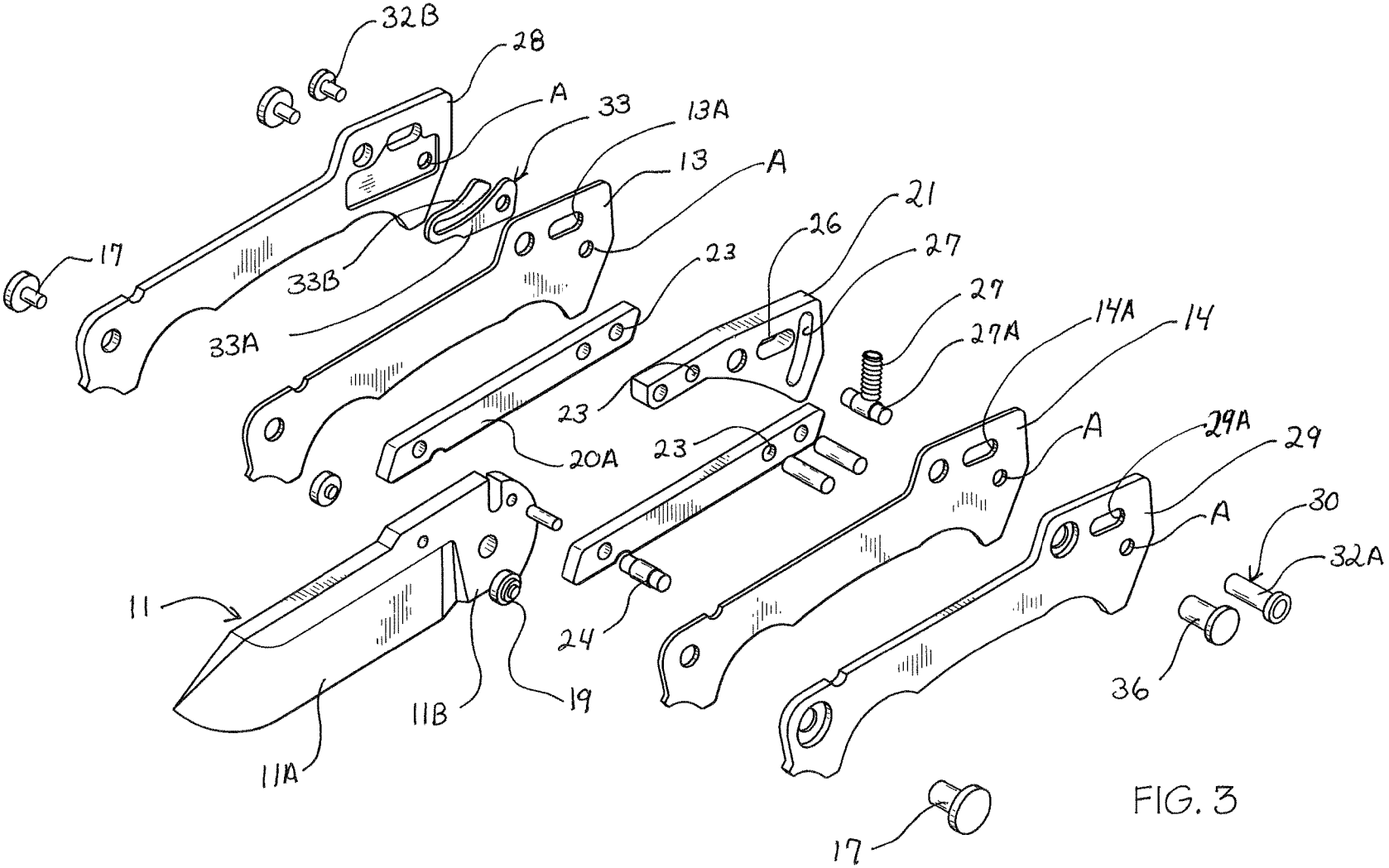
FIG. 3 is an exploded assembly view of a folding knife in open position.

Referring to FIGS. 1 and 2 of the drawings, a folding knife 10 of the invention can be seen in unfolded locked position. The knife 10 has a blade portion 11 pivotally secured to a handle and frame support portion 12. The handle and frame support portion 12 has a pair of frame members 13 and 14 with a dual exterior locking bar portion 15 pivotally secured therebetween. The blade portion 11 is pivotally secured via a hinge pin 17 therethrough for manual displacement defining a folding knife configuration. The blade portion 11 has a blade 11A and a shank 11B with a blade pin 18 and a thumb engagement stud 19 as best seen in FIG. 3 of the drawings.

The dual locking bar portion 15 comprises a pair of identical locking bars 20A and 20B secured to respective side of a bar spacer spring receiving fitting 21 by a pair of longitudinally spaced pins 22, which extend through aligned apertured pairs at 23 in their respective locking bars 20A and 20B and bar spacer spring receiving fitting 21.

A blade engagement pin 24 extends through the spaced locking bars 20A and 20B in oppositely disposed relation to said pins 22. The bar spacer spring receiving fitting 21 has an elongated spring receiving opening 25 and an elongated locking bar locking pin receiving opening 26 therethrough. A locking bar spring 27 is therefore positioned within the spring receiving opening 25 on a stop pin 27A, which is registered within apertures A in the respective frame members 13 and 14 and corresponding oppositely disposed knife handles 28 and 29.

A safety release locking pin assembly 30 for release of the dual locking bar portion 15 is positioned within the bar spacer spring receiving fitting 21 and extends through the aligned openings 13A and 14A in the corresponding frame members 13 and 14 and 28A and 29A in the handle portions 28 and 29 for use, access, and blade release activation as will be described in greater detail hereinafter.

The knife handle 28 has a contoured recess area 31 therein, overlying the safety locking pin aligned openings 13A and 28A and the aligned spring stop pin aperture A. A moveable two-part safety blade release locking bar pin 32A is positioned through the corresponding aligned handle portions 28 and 29 openings and is secured to one another for respective movement within the elongated locking pin opening 26.

A bifurcated resilient element 33, best seen in FIG. 3 of the drawings, is retained within the handle recess area 31. The resilient element 33 has a contoured apertured base portion 33A through which the spring stop pin 27A extends retaining same. A correspondingly contoured top portion 33B is therefore registerable against the locking pin assembly 30 as best seen in FIG. 4 of the drawings, providing spring resistance thereto.

In use, it will be seen that the elongated locking pin opening 26 has a transversally enlarged end portion at 26A which when in overlying alignment with the corresponding elongated opening at 28A and the handle portion 20A, will provide a unique locking pin retainment when under spring urged pressure by the hereinbefore described resilient element 33.

Figure 4:
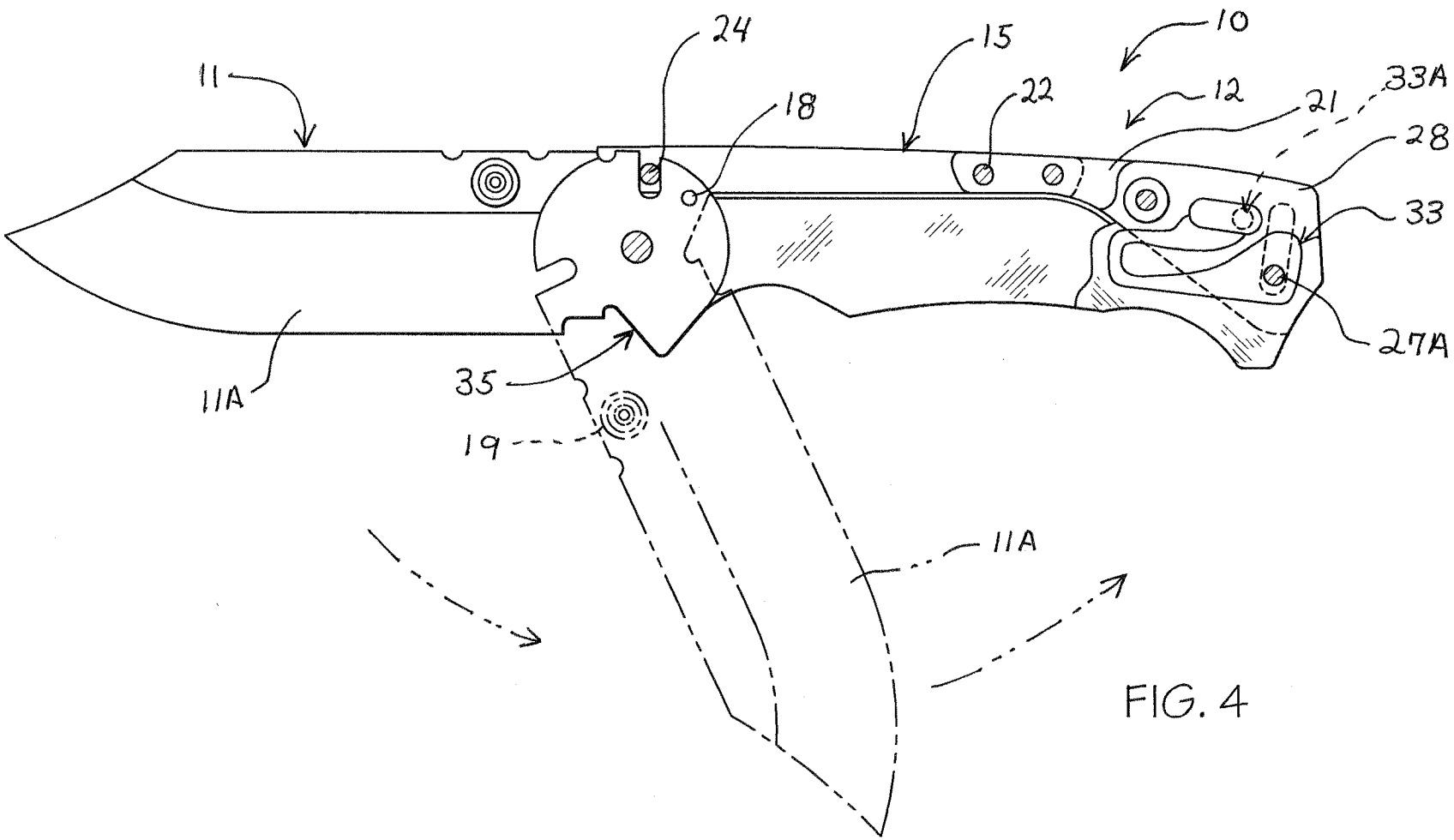
FIG. 4 is a side elevational view with portions broken away of the folding knife locking arm with pivot spring assembly and safety pin release in open lock position in solid lines, and partially closed position in broken lines.
Figure 5:
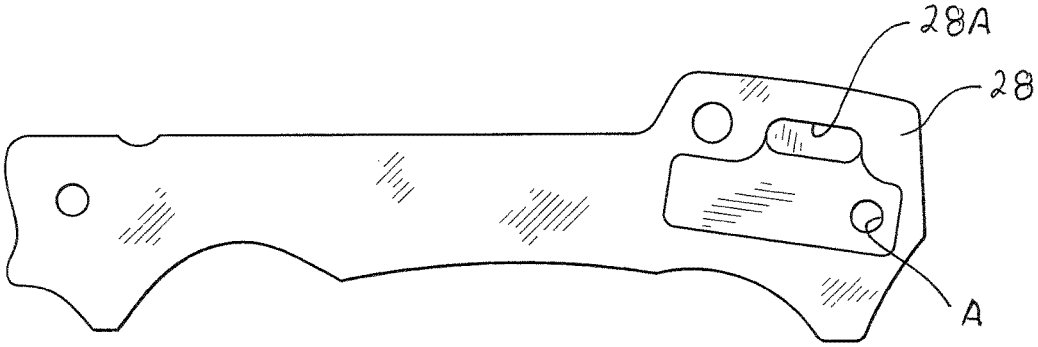
FIG. 5 is a side elevational view of the knife handle having a safety arm spring release recess mounting area therein.
Figure 6:
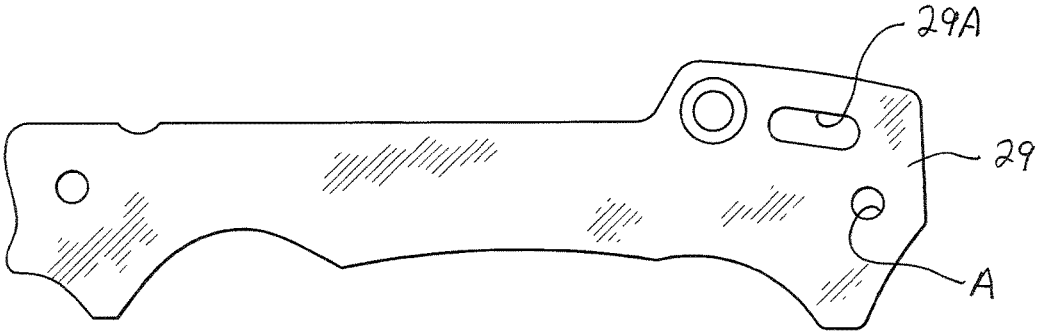
FIG. 6 is a side elevational view of the knife handle having a locking arm pivot and safety arm release apertures therein.

It will therefore when so engaged on the locking bar pin 32A, prevent the locking bar assembly 15 from pivoting movement when the blade engagement pin 24 is registerably engaged within the retainment notch 34 in the blade shank 11B in open lock position as illustrated best in FIG. 4 of the drawings.

Figure 7:
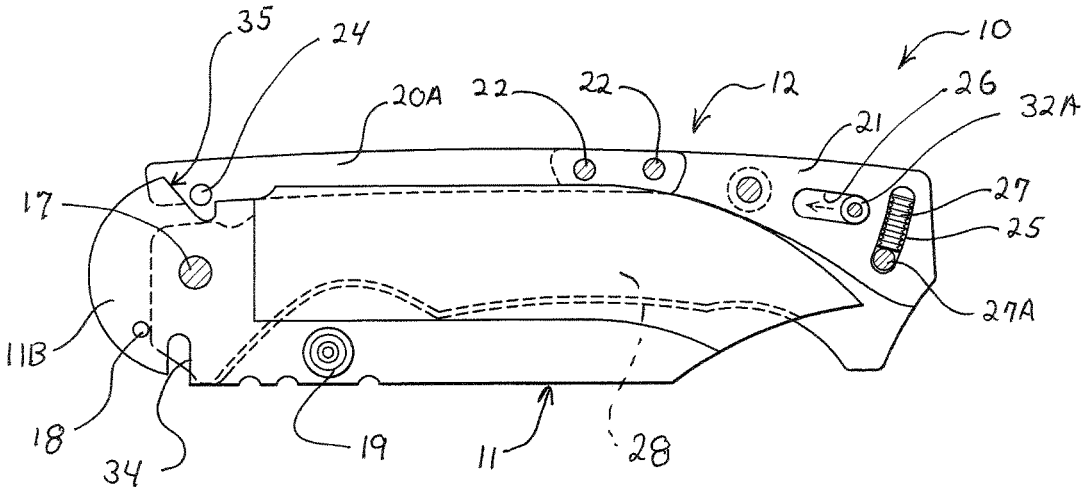
FIG. 7 is a side elevational view of the folding knife with portions broken away in closed locked position.

Alternately, the blade engagement pin 24 will be registerably engaged against a retainment release notch and incline surface 35 on the blade shank 11B when in closed position, as seen in FIG. 7 of the drawings. The locking bar pin 32A orientation will therefore maintain the blade portion 11 in either safety locked open or safety locked closed position, as described.

Referring now to operational FIGS. 7, 8, 9 and 10 of the drawings, the blade 11A opening sequence can be seen with portions of the folding knife 10 removed for illustration clarity.

Figure 8:
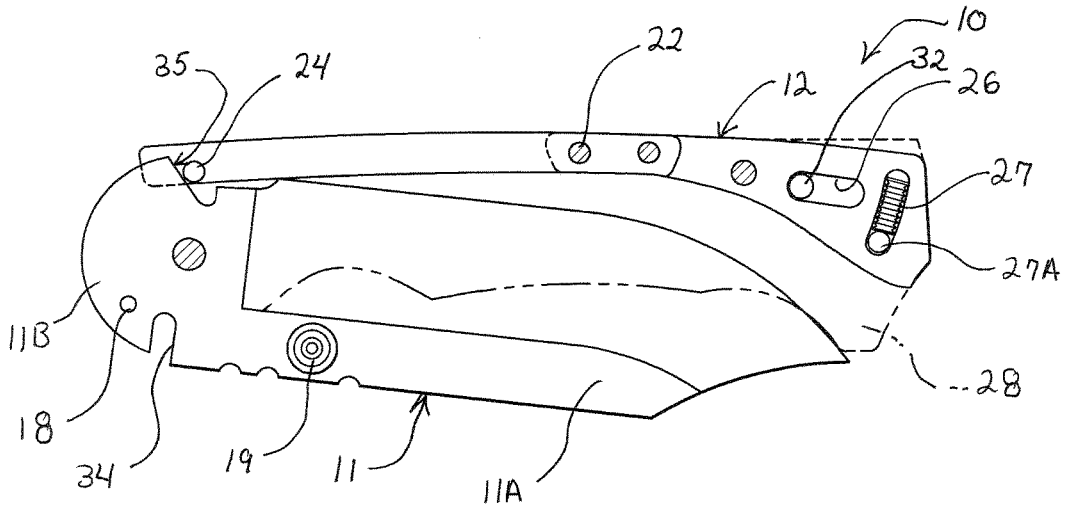
FIG. 8 is a side elevational view of the folding knife in initial blade opened position with portions broken away for illustration.

Referring now to FIG. 7 of the drawings, the folding knife 10 of the invention is shown in fully closed blade locked position with the moveable safety release locking bar pin 32A therefore in lock position within the locking pin opening 26. This orientation prevents the blade 11 once engaged to be opened. Once the locking bar pin 32A is slid forward into the enlarged end portion 26A (unlocked position) the locking bar assembly 15 will initially be maintained in its static position under the spring 27 pressure. However, by user blade engagement via the blade thumb engagement stud 19, the blade 11A can be pivoted to open and lock position as the blade engagement pin 24 slides initially against the blade shank incline surface 35 under the pivoting action of the blade portion 11 on its pivot pin 17, as illustrated in FIG. 8 of the drawings, and in FIG. 4 in broken lines.

Figure 9:
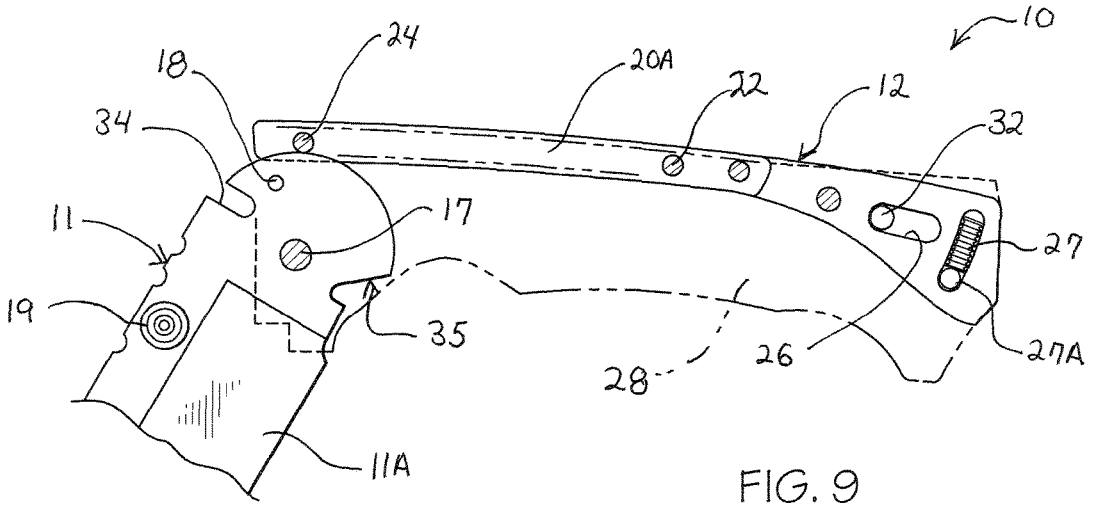
FIG. 9 is a side elevational view of the folding knife in partially opened position with portions broken away for illustration.
Figure 10:
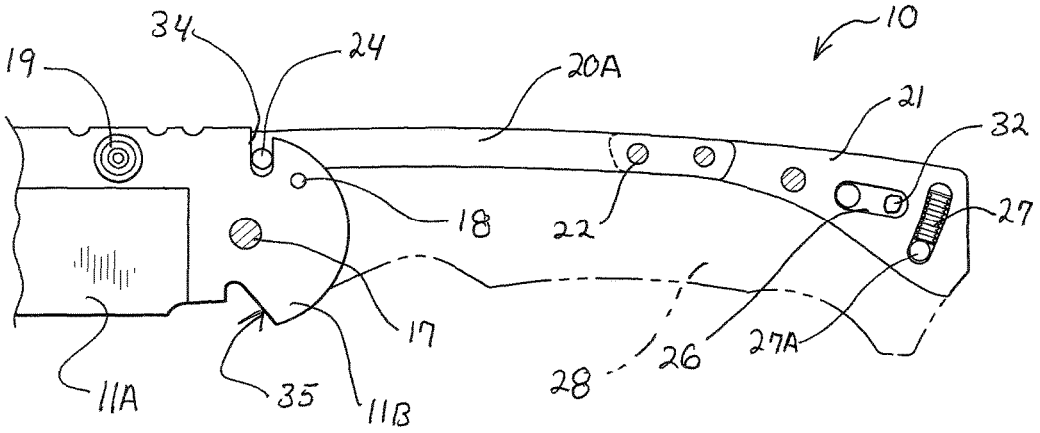
FIG. 10 is a side elevational view of the folding knife in fully opened lock position with portions broken away for illustration.

As the blade 11A continues to rotate towards open position, the blade engagement pin 24 follows the blade shanks 11A perimeter arcuate edge pivoting the dual locking bar portion 15 on pivot pin 36, as seen in FIG. 9 of the drawings. Once the blade 11A reaches the fully opened position in longitudinal alignment with the handle and frame portion 12, the blade engagement pin 24 will engage and be resiliently retained within the locking notch 34 in the blade shank 11 as shown in FIGS. 4 and 10 of the drawings. The safety locking bar pin 32A is then slidably repositioned to its locked position and held in place by the hereinbefore described resilient element 33. The blade pin 18 within the blade shank 11A provides a blade stop against the respective handles 28 and 29, as seen in FIG. 4 in blade open position and in FIG. 7 in blade closed position.

It will be seen that the dual locking bar portion 15 provides by unique exterior orientation an improved highly effective and superior blade engagement and safety blade locking mechanism in a visual orientation for a fold knife, and it will be apparent to those skilled in the art that various changes and modifications may be made therein without departing from the spirit of the invention.

Therefore I claim:

1. A folding knife comprises, an elongated handle and frame portion, an elongated knife blade having an elongated sharp edge portion and an apertured shank end portion, a thumb engagement stud extending from said shank end portion, said knife blade pivotally secured within said handle and frame portion for movement of said knife blade from a first closed locked position to a second open lock position, a locking bar portion having a pair of spring urged parallel spaced elongated locking bars pivoted from within said handle frame portion for selective engagement with said apertured shank end portion from said first closed lock position to said second open lock position, a bar spacer fitting affixed directly to and between and extending longitudinally beyond said elongated locking bars, said bar spacer fitting pivoted from within said handle frame portion by a locking bar pivot pin, an inclined surface notch and notch surface in oppositely disposed relation to one another in said shank end portion, a shank engagement pin extending between said elongated locking bars registerable selectively within respective inclined surface notch and said notch surface in said apertured shank end portion, a cylindrical locking bar pin moveably positioned in said handle and frame portion extending through and captured in an elongated slot within in said bar spacer fitting portion extending beyond said elongated locking bars.

2. The folding knife set forth in claim 1 wherein said handle portion has a co-planar bifurcated resilient element in selective registration with said cylindrical locking bar pin, said cylindrical locking bar pin moveable from a first lock position engaged on said resilient element to a second unlocked position within said elongated slot in said bar spacer fitting.

3. The folding knife set forth in claim 1 wherein said locking bar pivot pin is positioned through the portion of said bar spacer fitting that extends longitudinally beyond said elongated locking bars and is adjacent to said elongated slot within said bar spacer fitting.

4. The folding knife set forth in claim 1 wherein said spacer bar fitting has a spring and safety pin registerable therein.

5. The folding knife set forth in claim 1 wherein a blade stop in selectively registerable with a handle support portions.

6. The folding knife set forth in claim 1 wherein a resilient element in said handle support portion is engageable against said cylindrical locking bar pin.

7. The folding knife set forth in claim 1 wherein said bar spacer fitting has a locking bar pivot pine, an elongated contoured safety locking bar pin receiving opening having an enlarged end portion engaging said safety locking bar pin therein in an unlocked position.

8. The folding knife set forth in claim claim 1 wherein a portion of said elongated locking bars overlie and are secured to said bar spacer fitting.

9. The folding knife set forth in claim 1 wherein said elongated slot within said bar spacer fitting has an enlarged interior end portion engaging said movable locking bar pin therein in locked position.

10. The folding knife set forth in claim 1 wherein said bar spacer fitting portion extending beyond said elongated locking bars has a spring receiving opening, a spring and safety pin registerable therein.

* * * * *